US009725297B2

(12) United States Patent
Kraus et al.

(10) Patent No.: US 9,725,297 B2
(45) Date of Patent: Aug. 8, 2017

(54) CHEMICAL PRODUCT DISPENSING INDEPENDENT OF DRIVE FLUID FLOW RATE

(71) Applicant: Ecolab USA Inc., St. Paul, MN (US)

(72) Inventors: Paul R. Kraus, Apple Valley, MN (US); Keith E. Olson, Apple Valley, MN (US); Sherri L. Tischler, Inver Grove Heights, MN (US)

(73) Assignee: Ecolab USA Inc., St. Paul, MN (US)

( * ) Notice: Subject to any disclaimer, the term of this patent is extended or adjusted under 35 U.S.C. 154(b) by 124 days.

(21) Appl. No.: 14/472,140

(22) Filed: Aug. 28, 2014

(65) Prior Publication Data

US 2016/0060095 A1 Mar. 3, 2016

(51) Int. Cl.

| | |
|---|---|
| ***B67D 7/66*** | (2010.01) |
| ***B67D 7/74*** | (2010.01) |
| ***A47L 15/44*** | (2006.01) |

(52) U.S. Cl.

CPC ..... *B67D 7/66* (2013.01); *A47L 15/4418* (2013.01); *B67D 7/74* (2013.01)

(58) Field of Classification Search

CPC ..... G05D 11/008; G05D 11/006; Y10T 137/2516; Y10T 137/2514; A47L 15/44; B67D 7/74; B67D 7/66

USPC ..... 137/99; 222/57, 129.2, 334

See application file for complete search history.

(56) References Cited

U.S. PATENT DOCUMENTS 917,139 A * 4/1909 Robison ..... C02F 1/686 137/99
3,549,048 A * 12/1970 Goodman ..... G05D 11/006 137/99
4,651,765 A * 3/1987 Beth ..... G05D 11/008 137/564.5
5,167,800 A * 12/1992 Ringer ..... C02F 1/687 137/101.11
6,029,688 A * 2/2000 Kaufman ..... G05D 11/006 137/565.12

(Continued)

FOREIGN PATENT DOCUMENTS

WO 2007109727 A2 9/2007
WO 2008115203 A1 9/2008

OTHER PUBLICATIONS

"Suma® Optifill, Dilution Control System for 3 Compartment Sinks," JohnsonDiversey, 2008, 1 pp. (Applicant points out that, in accordance with MPEP 609.04(a), the 2008 year of publication is sufficiently earlier than the effective U.S. filing date and any foreign priority date of Aug. 28, 2014 so that the particular month of publication is not in issue.).

(Continued)

*Primary Examiner* — Paul R Durand
*Assistant Examiner* — Robert Nichols, II
(74) *Attorney, Agent, or Firm* — Shumaker & Sieffert, P.A.

(57) ABSTRACT

A fluid product dispenser is sized to removably receive a product package containing a supply of the fluid product. The product package includes an internally integrated fluid pump, and the dispenser includes a drive unit powered by flow of a fluid. Flow of the fluid powers the drive unit, which in turn drives the pump internal to the product package, resulting in dispensation of the fluid product in a product/fluid ratio that is independent of the fluid flow rate.

12 Claims, 3 Drawing Sheets

(56) References Cited

U.S. PATENT DOCUMENTS

| | | | | |
|---|---|---|---|---|
| 6,651,849 | B2 * | 11/2003 | Schroeder | B67D 1/0021 222/129.1 |
| 7,674,100 | B2 | 3/2010 | Hayes-Pankhurst et al. | |
| 8,342,364 | B2 | 1/2013 | Bertucci et al. | |
| 2010/0108714 | A1 * | 5/2010 | Bertucci | G05D 11/006 222/57 |
| 2011/0024457 | A1 * | 2/2011 | Somerfield | E03C 1/046 222/145.1 |
| 2013/0008522 | A1 | 1/2013 | Bertucci et al. | |

OTHER PUBLICATIONS

"Quantex, Unique disposable liquid pump technology, Quantex pump applications," PDD Innovations Ltd., retrieved from http://quantex-arc.com/assets/uploads/files/PDD_Quantex-Applications_LoRes_1231251827.pdf on Dec. 8, 2014, 5 pp.

"Specifications of the Quantex Pump," Quantex Arc Ltd, retrieved from http://www.quantex-arc.com/pump-characteristics/specifications/ on Dec. 5, 2014, 9 pp. Includes Figures dated Aug. 15, 2012, May 5, 2013, Feb. 11, 2013, May 15, 2013, Sep. 30, 2013, and Jan. 1, 2014.

* cited by examiner

CHEMICAL PRODUCT DISPENSING INDEPENDENT OF DRIVE FLUID FLOW RATE

TECHNICAL FIELD

The disclosure relates to chemical product dispensing.

BACKGROUND

Chemical products are often packaged in a concentrated form that, depending upon the application, may be diluted with water to create a use solution having a desired concentration. These concentrates or ultra concentrates may permit more efficient transport and storage over their less concentrated counterparts. Such concentrated chemical products may include, for example, detergents and other cleaning, disinfecting, or sanitizing products. The concentration of the chemical product in the use solution may be important to ensure effective cleaning, disinfecting, and/or sanitizing. For example, there are many applications where the concentration of the use solution is regulated to ensure effective sanitizing or disinfecting.

SUMMARY

In general, this disclosure relates to metering and dispensing controlled quantities of a fluid product. The fluid product may include, for example, a fluid chemical product, a concentrated fluid chemical product, or an ultra concentrated fluid chemical product.

In one example, the disclosure is directed to a dispensing apparatus comprising a housing having a cavity sized to receive a product package containing a fluid product to be dispensed, a fluid drive unit having an inlet directly connected to receive a supply of a fluid such that flow of the fluid causes rotation of the water drive unit, an outlet from which the fluid exits the housing, and a pump engagement mechanism configured to removably connect the fluid drive unit to a pump internally integrated into the product package and to transfer rotational motion of the fluid drive unit to the pump, resulting in dispensing of the fluid product from the product package responsive to rotation of the water drive unit. The fluid may be a liquid or a gas.

In another example, the disclosure is directed to an apparatus, comprising a product package formed by a plurality of sidewalls forming an enclosed cavity that contains a fluid product to be dispensed from the product package, an outlet through which the fluid product is dispensed from the cavity of the product package, and a pump internally integrated into the cavity of the product package and fluidly connected to the outlet to pump the fluid product to the outlet of the product package, the pump further including a pump engagement coupling configured to be removably connected to a drive unit of a chemical product dispenser. The fluid may be a liquid or a gas.

In another example, the disclosure is directed to a dispensing system, comprising a product package defined by a plurality of sidewalls forming an enclosed cavity that contains a fluid chemical product to be dispensed from the product package, the product package further including an outlet through which the fluid chemical product is dispensed from the cavity, a pump internally integrated into the product package that dispenses the fluid chemical product from the cavity of the product package through the outlet of the product package, and a pump engagement coupling externally accessible through at least one of the product package sidewalls, a housing having a cavity sized to receive the product package; and a fluid drive unit having an inlet conduit connected to receive a diluent and an outlet conduit through which the received diluent is dispensed from the housing, wherein flow of the diluent from the inlet conduit causes rotation of the fluid drive unit, the fluid drive unit configured to be removably connected with the pump engagement coupling to transfer rotational motion of the fluid drive unit to the pump, the fluid chemical product dispensed from the product package and the diluent delivered from the housing forming a use solution having a concentration of the fluid product that is independent of a flow rate of the diluent.

The details of one or more examples are set forth in the accompanying drawings and the description below. Other features and advantages will be apparent from the description and drawings, and from the claims.

DETAILED DESCRIPTION

In general, this disclosure relates to metering and dispensing controlled quantities of a fluid product independent of fluid flow rate. The fluid product may include, for example, a fluid chemical product, such as a concentrated fluid chemical product or an ultra-concentrated fluid chemical product. A dispenser is sized to removably receive a product package containing a supply of the fluid product. The product package includes an internally integrated fluid pump, and the dispenser includes a drive unit powered by flow of a fluid, such as a diluent or a gas. Flow of the fluid powers the drive unit, which in turn drives the internally integrated pump, resulting in dispensation of the fluid chemical product in a product/fluid ratio that is independent of the fluid flow rate.

Figure 1:
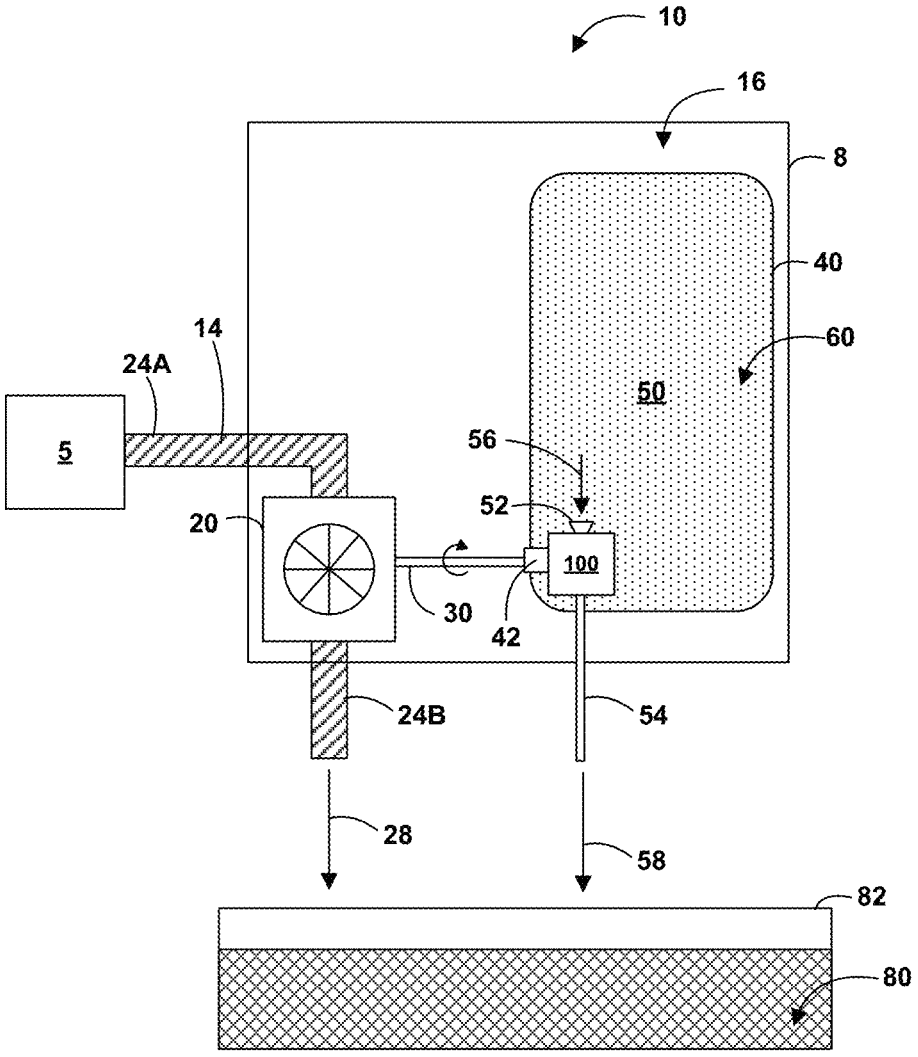
FIG. 1 is a schematic diagram illustrating an example fluid-driven chemical product dispensing apparatus.

FIG. 1 is a schematic diagram illustrating an example fluid-driven chemical product dispensing apparatus 10. Dispenser 10 includes a housing 8 having a cavity 16 sized to receive a product package 50 containing a fluid chemical product 60 to be dispensed. Fluid product 60 may include, for example, a concentrated fluid chemical product to be dispensed into a diluent to form a use solution.

Product package 50 may include a rigid container, a pouch, a bottle, a bag, a bag-in-box, a bag-in-bottle, or any other type of product package suitable for dispensing fluid products. Product package 50 includes one or more sidewalls 40 that form an enclosed cavity for holding fluid product 60. Product package 50 further includes a product outlet 54 through which the fluid product is dispensed. A suitable air-gap may be inherent in the product dispensing apparatus to avoid potential problems with suck-back of product into a municipal water line if the mains water pressure drops. A pump 100 is internally integrated into package 50, and is configured to pump the fluid product 60 from package 50 through the outlet 54. Pump 100 draws fluid product 60 in through an inlet 52, as indicated by arrow 56, and delivers the pumped fluid to product outlet 54 from which the fluid product is dispensed.

Dispenser 10 further includes a drive unit 20 powered by flow of a fluid through a fluid flow path 14. In some examples, the drive fluid may include a diluent, such as water or an aqueous solution. In other examples, the drive fluid may include a gas. Fluid flow path 14 includes an inlet conduit 24A and an outlet conduit 24B. Fluid is delivered to drive unit 20 through inlet conduit 24A. The fluid exits drive unit 20, and thus dispenser 10, through outlet conduit 24B as indicated by arrow 28. In this example, inlet conduit 24A is directly connected to receive water from a source 5, such as a municipal water supply system, reservoir, or other water source. For example, inlet conduit 24A of dispenser 10 may be plumbed directly to the incoming water supply or otherwise directly connected to a water or fluid source. Source 5 may also be a container, reservoir, sump or any other source of fluid, and the disclosure is not limited in this respect. In other examples, use solution 80 from reservoir 82 may be pumped or otherwise delivered to inlet conduit 24A to power fluid drive unit 20.

In this example, drive unit 20 includes a wheel drive unit that converts the energy from flow of the diluent or other drive fluid into a rotational form of power. In one example, fluid drive unit includes a water wheel. A water wheel or other wheel drive unit typically includes one or more vanes or blades (which may be straight, concave or bucket-shaped) that form a driving surface for the flowing diluent. However, it shall be understood that fluid drive unit 20 may include other types of drive units, and that the disclosure is not limited in this respect.

In this example, system 10 is a closed system in the sense that all of the fluid delivered from source 5 through the fluid flow path 14 is captive in the fluid flow path 14 and is thus used to power the drive unit 20 until it is ultimately delivered to the reservoir 82 or other end use destination. This may help to ensure that the amount of chemical product dispensed is in the correct proportion to the amount of fluid delivered to the end use application so as to maintain a desired concentration of the chemical product in the resulting use solution.

In the example of FIG. 1, rotation of drive unit 20 rotates a drive shaft 30, which in turn transmits rotational motion of the drive unit to pump 100. Pump 100 is thus driven by flow of the fluid through the drive unit, and both fluid (e.g., diluent) and fluid product are dispensed to form a use solution 80. The fluid chemical product and the diluent are dispensed in a constant proportion so that they form a use solution having a concentration of the fluid chemical product that is independent of the flow rate of the diluent.

In this example, the use solution 80 is formed in a use solution reservoir 82. However, it shall be understood that the use solution may be formed in any of a container, reservoir, bucket, pail, sink, 3 compartment sink, dishmachine, laundry machine or may be directed to any other end use application. Although in this example product outlet 54 and fluid outlet 24 are shown as separate components, in some examples product outlet 54 and fluid outlet 24 may merge or combine to form a single diluent/fluid product outlet from which the use solution 80 is dispensed. An air-gap may be implemented as required by local codes.

Drive shaft 30 may be flexible or non-flexible, depending in part upon the application, the physical location of the dispenser, the incoming water supply, etc. For example, a flexible drive shaft may permit a product container with integrated pump to be stored remote from the drive mechanism.

In one example, a pump engagement coupling 42 provides for a removable connection of pump 100 with the drive shaft 30 and thus the drive unit 20. This permits product package 40 to be removably installed into dispenser 10 to facilitate refill or replacement. Pump engagement coupling 42 thus permits dispenser 10 to be refilled with a new supply of fluid product 60 when, for example, a product package becomes empty or a different fluid product is desired. In one example, the pump engagement coupling 42 is part of product package 40, and is externally accessible through at least one of the product package sidewall as shown in FIG. 1. In some examples, pump engagement coupling 42 may include two mated connectors, a first connector integrated into housing 8 and a second connector integrated into a sidewall of product package 40. The first and second mated connectors may include a quick-connect or snap-type connection that mechanically connects drive shaft 30 with pump 100, and that also permits convenient installation and removal of product package 40 into the dispenser 10. Although certain mechanisms for providing for connection/installation of a product package into a dispenser are described herein, those of skill in the art will readily understand that many other mechanisms that provide for convenient installation and removal of a product package may be used, and that the disclosure is not limited in this respect.

In use, a product package 40 may be installed into a dispenser 10 by inserting the product package 40 into the cavity 16 of housing 8. Housing 8 may include a door or lid (not shown) that provides for access to the interior cavity 16 of housing 8. The connector integrated into the product package 40 of pump engagement coupling 42 is aligned and connected with the connector integrated in the dispenser 10 or the housing 8.

When dispensation of the fluid chemical product 60 is desired, an operator may manually turn on supply 5 to start the flow of fluid to inlet conduit 24A. Alternatively, an electronically controllable valve may be provided to electronically control flow of the fluid into the dispenser. Flow of fluid through drive unit 20 rotates drive shaft 30. Rotation of the drive shaft 30 rotates the pump mechanism 100. Rotation of the pump mechanism 100 draws fluid product 60 into the pump via pump inlet 52 as indicated by arrow 56. The fluid chemical product is pumped to dispenser outlet 54 and directed to reservoir 82, where it combines with the drive fluid (e.g., diluent) to form a use solution 80.

In some examples, the volumetric flow rate of chemical product dispensed by pump 100 is proportional to the flow rate of the fluid through the drive unit 20. The ratio of the volumetric flow rate of the chemical product dispensed by pump and the volumetric flow rate of the fluid is thus substantially constant. In this way, the dispenser 10 may maintain a dilution of the dispensed fluid product 60 that is independent of the flow rate of the diluent through the drive unit 20. Dispenser 10 may accurately dispense relatively small amounts of concentrated fluid product while maintaining a concentration of the end use solution within a desired range.

In some examples, product package 50 along with the internally integrated pump 100 may be disposable. For example, when the product package 40 is empty, the exhausted product package, including the internally integrated pump, may be removed from the dispenser, discarded, and replaced with another product package. Alternatively, when a change in the chemical product to be dispensed is desired, the product package may be removed from the dispenser and a replaced with a new product package containing the desired chemical product.

Pump 100 may be implemented using many different types of pumps. Considerations of the type of pump to take into account include, for example, the size and shape of the product package 40, the size and shape of the dispenser 10, the type of drive mechanism with which the pump is to be driven, the chemical product(s) to be dispensed, the pressure, viscosity and/or flow rate of the incoming drive fluid, the desired dispense rate (volume/time) of the chemical product, the desired relationship between the fluid flow rate and the dispense flow rate, whether or not the product package is to be disposable, or any other factor that may affect the type of pump to be used.

In one example, the ratio of the amount (volume) of chemical product fluid dispensed from pump 100 per unit time versus the amount (volume) of the incoming drive fluid is constant. That is, the flow rate of the chemical product dispensed versus the flow rate of the incoming drive fluid is constant. In this example, the amount of chemical product dispensed into the use solution reservoir 82 (as indicated by arrow 58) and the amount of fluid dispensed into use solution reservoir 82 (as indicated by arrow 28) will result in a use solution having a known, constant concentration, regardless of the flow rate, pressure, or volume of fluid driving the drive unit 20.

In one example, pump 100 may be implemented using a fixed displacement rotary pump, in which the flow through the pump per rotation of the pump is fixed. That is, the volume of fluid output per rotation of the pump is a known constant volume. In another example, pump 100 may be a peristaltic pump. In such an example, pump 100 includes a rotor with a number of "rollers" that compress a flexible tube containing the chemical product to be dispensed. As with the example of FIG. 1, the rotor is driven by drive unit. As the rotor turns, the part of the tube under compression is pinched closed thus forcing the chemical product to move through the tube.

In some examples, pump 100 may be implemented using a reciprocating or rotary positive displacement pump, such as a gear pump, a screw pump, a piston pump, a peristaltic pump, etc. As another example, pump 100 may be implemented using a velocity pump, such as a centrifugal pump, a radial flow pump, an axial flow pump, etc. Pump 100 may also be implemented using a gravity pump, or any other type of pump known to those of skill in the art. The displacement may be fixed or variable. In applications where the product package is to be discarded, the pump may be disposable. It shall therefore be understood that any type of pump capable of delivering fluids may be used, and that the disclosure is not limited in this respect.

System 10 may also include one or more gears (a gear train) to adjust the flow rate of chemical product dispensed versus the flow rate of the fluid 12 driving the drive unit 20. For example, system 10 may include a gear train designed to achieve a particular angular velocity of the drive shaft versus the angular velocity of the pump, thus controlling the amount of chemical product dispensed versus the amount of fluid driving the drive unit 20. In one example, pump engagement coupling 42 may include an input gear connected to drive shaft 30 that transmits rotational motion (power) from the drive shaft 30 through one or more additional gears to an output gear that drives pump 100. It shall be understood that any type of gear train may be used to achieve a desired ratio of the amount (volume) of fluid chemical product dispensed versus the amount (volume) of fluid (e.g., diluent) input into the system.

Figure 2:
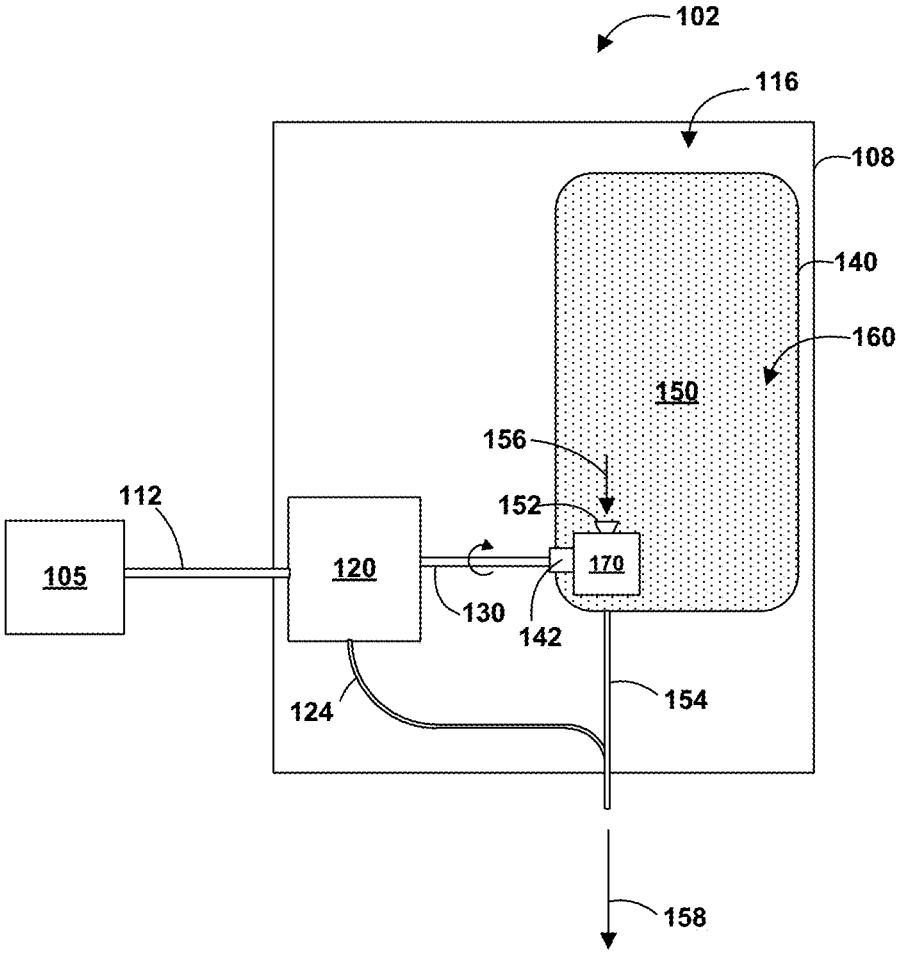
FIG. 2 is a schematic diagram illustrating an example gas-driven chemical product dispensing system.

FIG. 2 is a schematic diagram illustrating another example dispensing system 102. In FIG. 2, a source of compressed air or other gas 105 drives a gas-drive unit 120, which in turn drives a pump 170. Dispenser 102 includes a housing 108 having a cavity 116 sized to receive a product package 150 containing a fluid product 160 to be dispensed. In this example, fluid product 160 may include, for example, a fragrance in the form of a fluid chemical product that is dispersed. The fluid chemical product may be a liquid or a gas. In applications where the fragrance is dispersed into the ambient air, dispenser 102 may operate as a fragrance dispenser or an air freshener, for example. Dispenser 102 disperses a metered amount of the fragrance or other fluid chemical product in direct proportion to the gas flow rate through the air-drive mechanism 120. The fluid chemical product may be dispensed/dispersed into the gas stream, which may enable better dispersion into the ambient environment.

Product package 150 may include a rigid container, a pouch, a bottle, a bag, a bag-in-box, a bag-in-bottle, or any other type of product package suitable for dispensing fluid products. Product package 150 includes one or more sidewalls 140 that form an enclosed cavity for holding a fluid product 160. Package 150 further includes a product outlet 154 through which the fluid product is dispensed/dispersed. A pump 170 internally integrated into package 50 dispenses the fluid product 60 from package 50. A drive shaft 130 transmits the rotational power of the gas-drive unit 120 to a pump engagement coupling 142, which in turn rotates the pump 170. Pump 170 draws fluid product 160 in through an inlet 152, as indicated by arrow 156, and delivers the pumped fluid to an outlet 154. The fluid chemical product may be dispensed/dispersed into the gas stream in conduit 124, and then dispersed/dispensed into the ambient environment as indicated by arrow 158.

As described above with respect to FIG. 1, pump engagement coupling 142 may include one or more gears to adjust the ratio of product dispensed through output port 154 to the amount of air or other gas used to drive the gas-drive unit 120.

Figure 3:
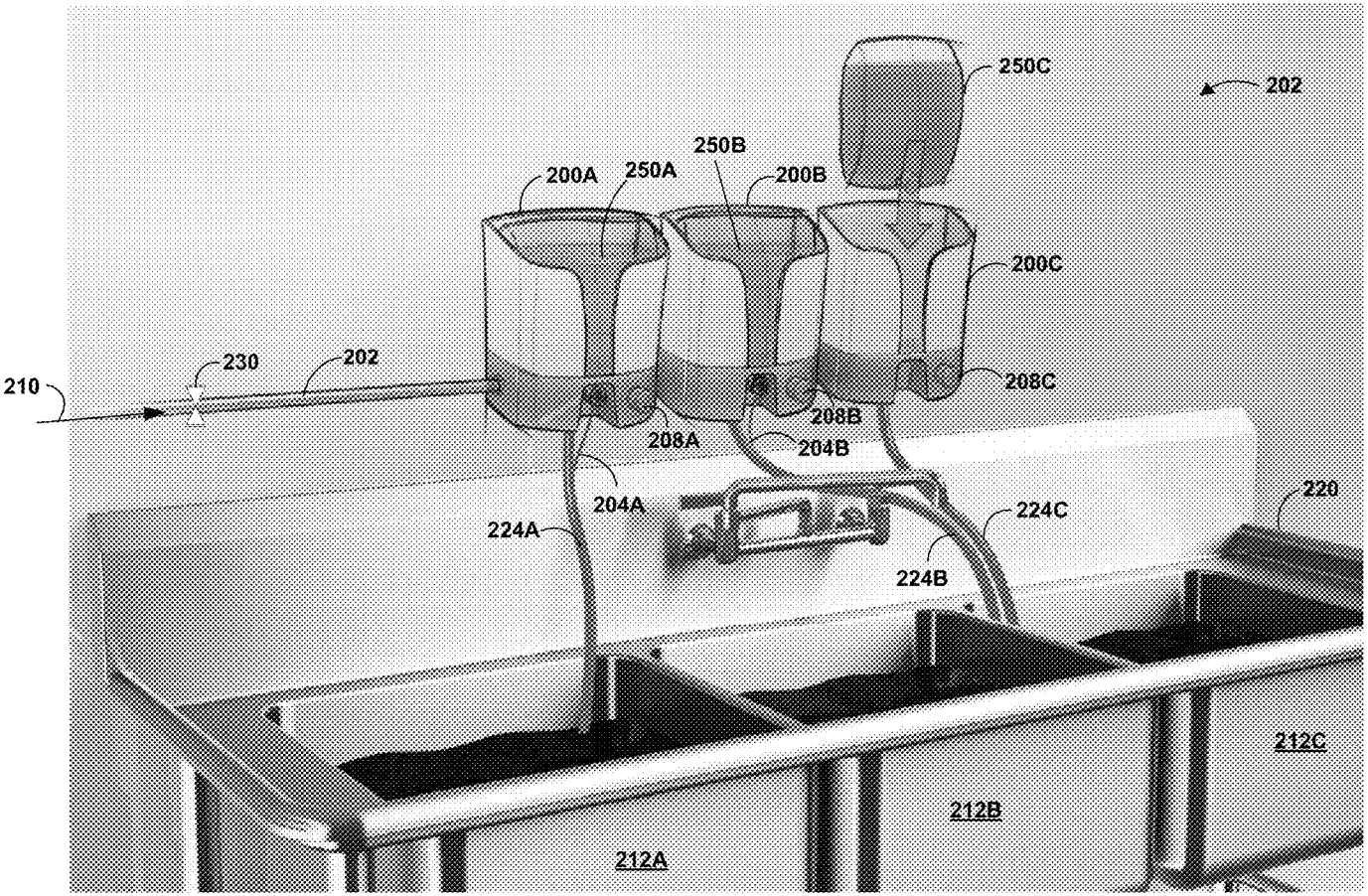
FIG. 3 is a schematic diagram of a three-compartment sink application using fluid drive dilution dispensers such as those shown in FIG. 1.

FIG. 3 is a schematic diagram of a three-compartment sink application using fluid drive dilution dispensers 200A-200C such as that shown in FIG. 1. Many institutions, such as schools and public cafeterias, or commercial establishments, use the three-compartment method to prevent the spread of disease and food-borne illnesses. An example three-compartment sink 220 includes a first sink 212A, a second sink 212B and a third sink 212C, one each for washing, rinsing, and sanitizing, respectively. Three fluid drive dilution dispensers 200A, 200B, and 200C are associated with each sink 212A, 212B, and 212C, respectively. In this example, a first product package 250A containing a first fluid product, such as a detergent, is housed in first dispenser 200A. A second product package 250B containing a second fluid product, such as a rinse agent or Fruit and Vegetable wash (or similar treatment chemistry), is housed in second dispenser 200B. A third product package 250C containing a third fluid product, such as a sanitizer, may be housed in third dispenser 200C. Each dispenser 200A-200C includes a pump engagement coupling (not shown in FIG. 3) permitting a product package to be removably installed in the respective dispenser and connected for transfer to power to a drive unit.

In the example of FIG. 3, each dispenser 200A-200C is directly plumbed or connected to a water supply via a diluent supply line 202. Flow of the diluent (water in this example) may be manually controlled by a flow activator (shown as a button in this example) 208A-208C located on each respective dispenser 200A-200C. At the commencement of a manual dish washing procedure, an operator starts the flow of diluent by turning on main valve 230 and engaging flow activator 208 on the desired product dispenser. Supply diluent flows through inlet line 202 as indicated by arrow 210 and into the activated fluid drive dilution dispenser 200A-200C. Each dispenser 200A-200C may be separately connected to receive the diluent from supply line 202. Diluent flow from supply line 202 drives drive units (not shown) in each of dispensers 200A-200C as described above with respect to FIG. 1. Diluent leaves dispensers 200A-200C through diluent outlet lines 224A-224C, respectively, and is delivered to the corresponding sink compartment 212A-212C. A pump, such as pump 100 shown in FIG. 1, is internally integrated into each of product packages 250A-250C and is removably connected to the drive unit of the corresponding dispenser. Chemical product is dispensed via outlet lines 204A-204C and into the corresponding sink compartment 212A-212C, respectively. Outlet lines 204A-204C may join with diluent outlet lines 224A-224C, as shown in FIG. 3.

In the example of FIG. 3, a proportional relationship between the volumetric flow rate of the incoming diluent 210 and the volumetric flow rate of the dispensed fluid chemical product is may be desirable so as to maintain a use solution having a desired concentration. In this way, the resulting use solution will have a known concentration regardless of the volume, pressure, and/or flow rate of the diluent into the water drive unit.

Various examples have been described. These and other examples are within the scope of the following claims.

The invention claimed is:

1. A dispensing system, comprising:

at least one product package defined by a plurality of sidewalls forming an enclosed cavity that contains a fluid chemical product to be dispensed from the at least one product package, the at least one product package further including:

an outlet through which the fluid chemical product is dispensed from the cavity; and a pump internally integrated into the at least one product package that dispenses the fluid chemical product from the cavity of the at least one product package through the outlet of the at least one product package;

a housing having a cavity sized to removably receive the at least one product package;

a fluid drive unit having an inlet conduit connected to receive a diluent and an outlet conduit through which the received diluent is dispensed from the housing, wherein flow of the diluent from the inlet conduit causes rotation of the fluid drive unit; and a pump engagement coupling including first and second mated connectors, the first mated connector integrated into the housing and the second mated connector integrated into one of the plurality of sidewalls of the at least one product package, the second mated connector sized to removably connect with the first mated connector to transfer the rotation of the fluid drive unit to the pump to dispense the fluid chemical product from the cavity of the at least one product package through the outlet of the at least one product package;

the fluid chemical product dispensed from the product package and the diluent delivered from the housing forming a use solution having a concentration of the fluid chemical product that is independent of a flow rate of the diluent.

2. The system of claim 1 further including a reservoir that receives the fluid chemical product dispensed from the cavity of the at least one product package and the diluent delivered from the housing to form the use solution.

3. The system of claim 2 wherein the reservoir includes one of a sink, a bucket, a pail, a bottle, a sump, a dishmachine, or a washing machine.

4. The system of claim 1 wherein the fluid chemical product includes at least one of a detergent, a rinse agent, a bleach, a fruit and vegetable wash, a disinfectant, or a sanitizer.

5. The system of claim 1 wherein the pump is a fixed volume displacement pump.

6. The system of claim 1 wherein the pump is one of a rotary pump, a gear pump, a screw pump, a piston pump, or a peristaltic pump.

7. The system of claim 1 wherein the diluent is water.

8. The system of claim 1 wherein the fluid drive unit comprises a wheel drive unit.

9. The system of claim 1, wherein the housing is mounted on a wall, and wherein the dispensed fluid chemical product and the diluent are delivered to a reservoir to form the use solution.

10. The system of claim 1, further comprising:

a second product package containing a second fluid chemical product to be dispensed; and a third product package containing a third fluid chemical product to be dispensed.

11. The system of claim 10, further comprising:

a first sink compartment into which the first fluid chemical product and the diluent are delivered to form the first use solution;

a second sink compartment into which the second fluid chemical product and the diluent are delivered to form a second use solution; and a third sink compartment into which the third fluid chemical product and the diluent are delivered to form a third use solution.

12. The system of claim 1, wherein the at least one product package is disposable.

* * * * *